US011320117B2

(12) United States Patent
Kinzer

(10) Patent No.: US 11,320,117 B2
(45) Date of Patent: May 3, 2022

(54) ZOOM MECHANISM FOR A LIGHT FIXTURE

(71) Applicant: Electronic Theatre Controls, Inc., Middleton, WI (US)

(72) Inventor: David Kinzer, Middleton, WI (US)

(73) Assignee: Electronic Theatre Controls, Inc., Middleton, WI (US)

( * ) Notice: Subject to any disclaimer, the term of this patent is extended or adjusted under 35 U.S.C. 154(b) by 0 days.

(21) Appl. No.: 17/223,500

(22) Filed: Apr. 6, 2021

(65) Prior Publication Data

US 2021/0317972 A1 Oct. 14, 2021

Related U.S. Application Data

(60) Provisional application No. 63/009,074, filed on Apr. 13, 2020.

(51) Int. Cl.
*F21V 14/06* (2006.01)
*F21V 5/04* (2006.01)
(Continued)

(52) U.S. Cl.
CPC ..... *F21V 14/06* (2013.01); *F21V 5/04* (2013.01); *F21V 7/0091* (2013.01); *F21V 13/04* (2013.01);
(Continued)

(58) Field of Classification Search
CPC . F21V 14/06; F21V 14/04; F21V 5/07; F21V 5/008; F21V 7/0091; F21V 13/04;
(Continued)

(56) References Cited

U.S. PATENT DOCUMENTS 4,681,451 A 7/1987 Guerra et al.
5,257,093 A 10/1993 Mager et al.
(Continued)

FOREIGN PATENT DOCUMENTS

DE 102005019832 A1 * 9/2006 ..... G02B 19/0061
WO 2013116723 A1 8/2013
(Continued)

OTHER PUBLICATIONS

Auer Lighting, "LED Reflector Lens Jupiter 110—Narrow," publicly available before Apr. 13, 2020 (1 page).
(Continued)

*Primary Examiner* — Erin Kryukova
(74) *Attorney, Agent, or Firm* — Michael Best & Friedrich LLP

(57) ABSTRACT

A light fixture includes a housing, a light source, and a zoom mechanism. The light source is supported within the housing and emits light. The zoom mechanism selectively varies a beam angle of the light emitted from the light fixture and includes a lens and a movable element. The lens is fixed relative to the light source. The movable element is movable relative to the lens between a first position and a second position. The lens reflects a portion of the light emitted by the light source via internal reflection when the movable element is in the first position. The movable element is closer to at least a portion of the lens when the movable element is in the second position to at least partially frustrate the internal reflection.

20 Claims, 4 Drawing Sheets

(51) Int. Cl.

| | |
|---|---|
| ***F21V 7/00*** | (2006.01) |
| ***F21V 13/04*** | (2006.01) |
| ***F21V 21/26*** | (2006.01) |
| ***F21V 21/088*** | (2006.01) |
| ***F21Y 115/10*** | (2016.01) |

(52) U.S. Cl.
CPC ..... *F21V 21/088* (2013.01); *F21V 21/26* (2013.01); *F21Y 2115/10* (2016.08)

(58) Field of Classification Search
CPC ..... F21V 14/065; F21V 14/045; F21W 2131/406
See application file for complete search history.

(56) References Cited

U.S. PATENT DOCUMENTS

| | | | | |
|---|---|---|---|---|
| 5,349,443 | A | 9/1994 | Guerra | |
| 6,636,359 | B2 | 10/2003 | Travers et al. | |
| 7,006,306 | B2 | 2/2006 | Falicoff et al. | |
| 7,486,854 | B2 | 2/2009 | Van Ostrand et al. | |
| 8,038,319 | B2 | 10/2011 | Bailey | |
| 8,402,665 | B2 | 3/2013 | Litvin et al. | |
| 8,641,230 | B1 | 2/2014 | Jiang | |
| 8,810,515 | B2 | 8/2014 | Reigneau et al. | |
| 9,200,776 | B2 | 12/2015 | Jorgensen et al. | |
| 9,389,422 | B1 | 7/2016 | Cakmakci et al. | |
| 9,587,801 | B2 | 3/2017 | Chen et al. | |
| 10,330,902 | B1 | 6/2019 | Marcoux | |
| 2007/0019416 | A1* | 1/2007 | Han | H01L 33/644 362/307 |
| 2009/0141336 | A1 | 6/2009 | Bohler | |
| 2011/0316812 | A1 | 12/2011 | Syam | |
| 2014/0233242 | A1* | 8/2014 | Koo | F21V 5/04 362/308 |
| 2016/0209001 | A1 | 7/2016 | Shatz et al. | |
| 2018/0058666 | A1* | 3/2018 | Huang | G02B 19/0028 |
| 2018/0078129 | A1 | 3/2018 | Matham et al. | |
| 2019/0212660 | A1 | 7/2019 | Kumar et al. | |
| 2019/0235372 | A1 | 8/2019 | Yamamoto | |

FOREIGN PATENT DOCUMENTS

| | | | | |
|---|---|---|---|---|
| WO | 2013138003 | A1 | 9/2013 | |
| WO | WO-2017186465 | A1 * | 11/2017 | G02B 3/08 |
| WO | 2019067647 | A1 | 4/2019 | |

OTHER PUBLICATIONS

ETC, "Wash Lights," <http://www.etcconnect.com/Products/Lighting-Fixtures/Wash-Lights/>, web page publicly available as early as Dec. 18, 2019, representative copy filed with IDS was captured Jun. 2021 (1 page).

LED Professional Review, "The technology of tomorrow for general lighting applications," Sep./Oct. 2008, Issue 09, ISSN 1993-890X, <https://www.led-professional.com/downloads/LpR_09_free_164389.pdf>, (56 pages).

Risse et al., "FIM, a Novel FTIR-Based Imaging Method for High Throughput Locomotion Analysis," PLOS ONE, Jan. 2013, vol. 8, Issue 1, e53963, <https://journals.plos.org/plosone/article/file?id=10.1371/journal.pone.0053963&type=printable>, (11 pages).

Visual Environment Technologies, ETC, "ColorSource Affordable can be rich," Brochure 7412L1002, Rev B, Oct. 2017 (5 pages).

* cited by examiner

ZOOM MECHANISM FOR A LIGHT FIXTURE

PRIORITY CLAIM

This application claims priority to U.S. Provisional Patent Application No. 63/009,074, filed Apr. 13, 2020, the entire contents of which are hereby incorporated by reference.

FIELD OF THE INVENTION

The present invention relates to zoom mechanisms for light fixtures.

BACKGROUND

Light fixtures, and particularly light fixtures for stage, studio, and architectural applications, may include a zoom mechanism to allow the width of the light beam emitted by the light fixture to be selectively widened or narrowed. Existing zoom mechanisms typically include a light pipe that homogenizes light from a light source, such as an RGBW LED, and a moving Fresnel lens that provides zoom and collimating functions. Such zoom mechanisms have several disadvantages. For example, in a spotlight or narrow zoom mode, such zoom mechanisms may have relatively low optical efficiency. In addition, a light pipe is typically a high cost component.

SUMMARY

The invention provides, in one aspect, a light fixture including a housing, a light source, and a zoom mechanism. The light source is supported within the housing and is configured to emit light. The zoom mechanism is configured to selectively vary a beam angle of the light emitted from the light fixture and includes a lens and a movable element. The lens is fixed relative to the light source. The movable element is movable relative to the lens between a first position and a second position. The lens is configured to reflect a portion of the light emitted by the light source via internal reflection when the movable element is in the first position. The movable element is closer to at least a portion of the lens when the movable element is in the second position to at least partially frustrate the internal reflection such that the lens is configured to reflect less of the portion of the light emitted by the light source when the movable element is in the second position than when the movable element is in the first position.

The invention provides, in another aspect, a zoom mechanism configured to selectively vary a beam angle of light emitted from a light source. The zoom mechanism includes a lens and a movable element movable relative to the lens between a first position and a second position. The lens is configured to reflect a portion of the light emitted by the light source via internal reflection when the movable element is in the first position. The lens is configured, when the movable element is in the second position, to frustrate the internal reflection such that less than the portion of the light emitted by the light source is emitted by the light source via total internal reflection.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1B:
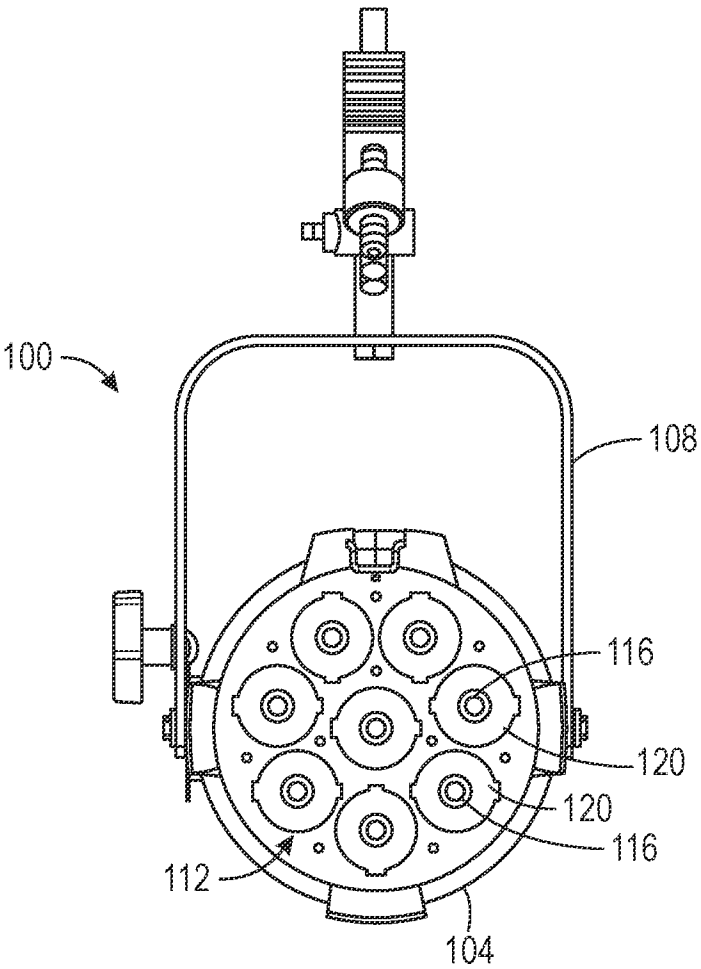
FIG. 1B is a front view of the light fixture of FIG. 1A.
Figure 1A:
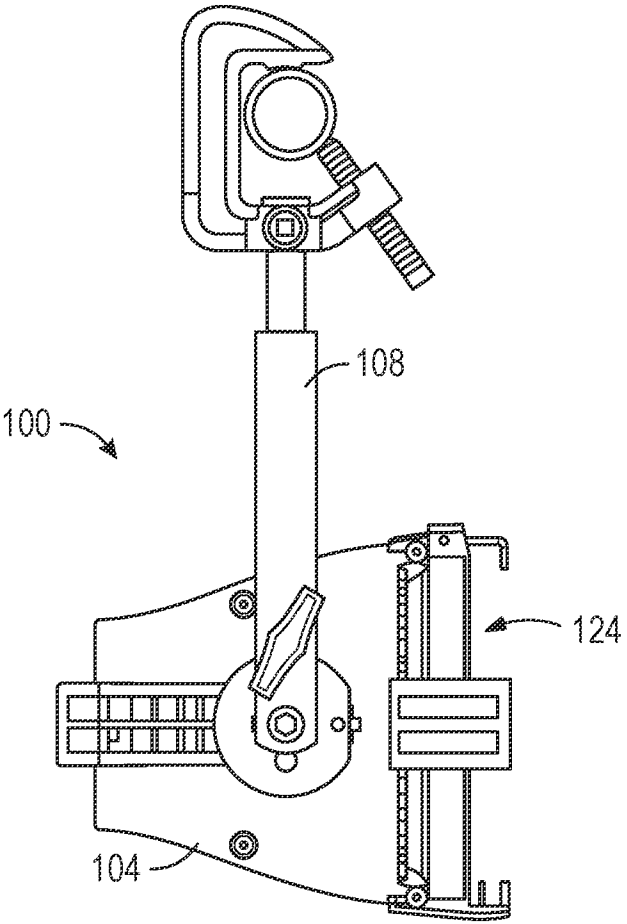
FIG. 1A is a side view of a light fixture according to one embodiment.

FIGS. 1A-B illustrate a light fixture 100 including a housing 104 and a yoke 108 pivotally coupled to the housing to facilitate mounting and positioning the light fixture 100 in a desired setting, such as a theater, studio, venue, or the like. The housing 104 encloses a light source assembly 112, such as an LED light engine (FIG. 1B). The housing 104 may also support a power supply, control electronics, and the like (not shown) for providing power to and controlling operation of the light source assembly 112.

Referring to FIG. 1B, the illustrated light source 112 assembly includes an array of LED light sources 116. Each LED light source 116 may include one or more white LEDs, multi-color LEDs (also referred to as multi-die or multi-chip LEDs), or any combination of white, colored, and/or multi-colored LEDs. Each of the LED light sources 116 is surrounded by an associated optic assembly 120. Each optic assembly 120 is configured to collimate and, in some embodiment, color-mix the light emitted by the associated LED light source 116 to provide a homogenous output. In some embodiments, the light fixture 100 may include one or more lenses, diffusers, filters, or other optical components coupled to a light output end 124 of the housing 104.

Figure 2:
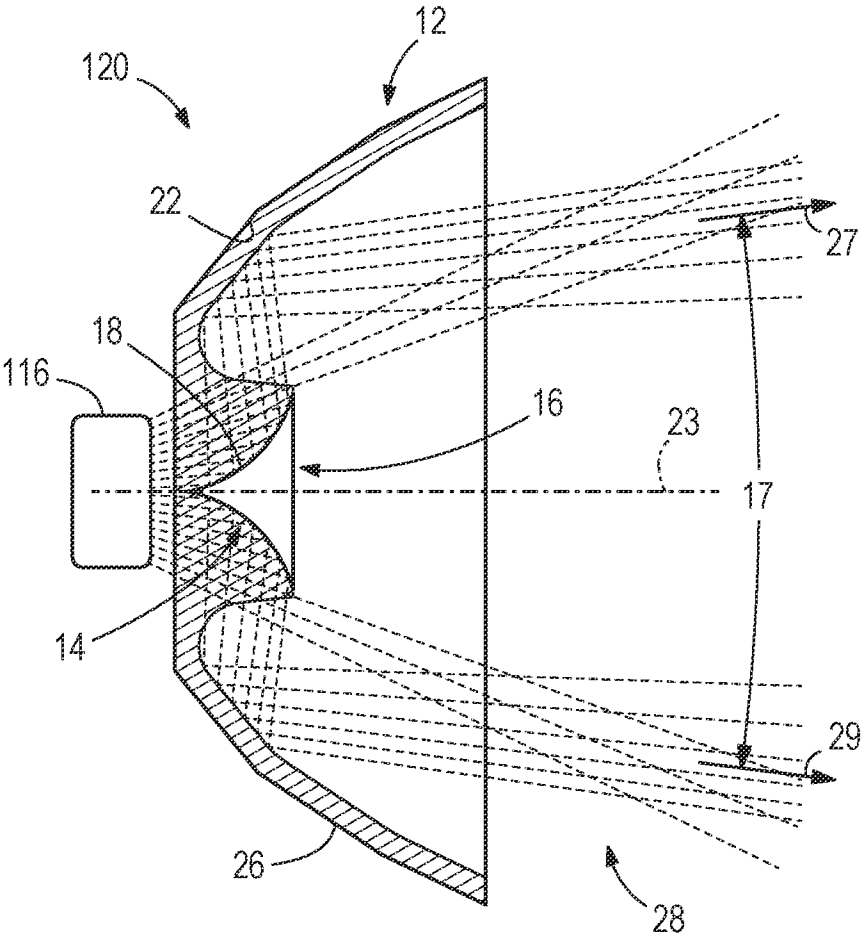
FIG. 2 is a schematic cross-sectional view of a zoom mechanism of the light fixture of FIG. 1A, the zoom mechanism illustrated in a narrow zoom configuration.

FIGS. 2-5 illustrate an embodiment of one of the optic assemblies 120. The illustrated optic assembly 120 includes a lens 12 having a central projecting portion 14 and an outer surround 26 (FIG. 2). The lens 12 is fixed relative to the LED light source 116, such that the LED light source 116 is operable to emit light into the lens 12. In the illustrated embodiment, the outer surround 26 is curved, and in some embodiments, the outer surround 26 may have a hemispherical or a generally parabolic shape. The projecting portion 14 includes a generally cone or vortex-shaped recess 16 formed on a back side of the projecting portion 14 opposite the LED light source 116.

When light reaches an interface between two materials with different refractive indices (e.g., air and the material of the central projecting portion 14 of the lens 12), substantially all of the light will be reflected if the angle of incidence of light at the interface is greater than a critical angle $\theta_C$. The critical angle $\theta_C$ is defined as a function of the refractive indices of the two materials. In particular, the critical angle $\theta_C$ may be calculated using the following equation, where 112 and m are the refractive indices of the two materials:

$$\theta_C = \sin^{-1}(n_2/n_1) \quad (1)$$

In the illustrated embodiment, an inner wall 18 of the recess 16 defines the interface between the material of the central projecting portion 14 and the surrounding air. The central projecting portion 14 and the inner wall 18 are shaped such that the angle of incidence of light emitted by the LED light source 116 on the inner wall 18 is greater than the critical angle $\theta_C$. As such, substantially all of the light emitted by the LED light source 116 is reflected by the projecting portion 14 via total internal reflection and onto an interior surface 22 of the surround 26.

The surround 26 reflects incident light to direct the light out of the lens 12 in a generally focused, collimated beam 28 (FIG. 2), i.e., with a generally narrow beam angle 17. The beam angle 17 is the angle at which light is distributed or emitted from the optic assembly 120. The beam angle 17 is defined the angle between two vectors (27, 29) opposed to each other over a centerline 23 of the beam 28, the two vectors (27, 29) defining a portion of the beam 28 where the luminous intensity is at least half that of a maximum luminous intensity of the beam 28. The luminous intensity of the beam 28 is measured in a plane normal to the beam centerline 23. In some embodiments, the surround 26 may be made of an optically translucent (e.g., clear) material, such as glass or silicone, and shaped such that the angle of incidence of light reflected on to the surround 26 is greater than the critical angle $\theta_C$. In such embodiments, the surround may reflect substantially all of the incident light out of the lens 12 by total internal reflection. In other embodiments, the interior surface 22 of the surround 26 may be coated with a reflective coating (e.g., a mirror coating) to reflect substantially all of the incident light out of the lens 12.

Figure 3:
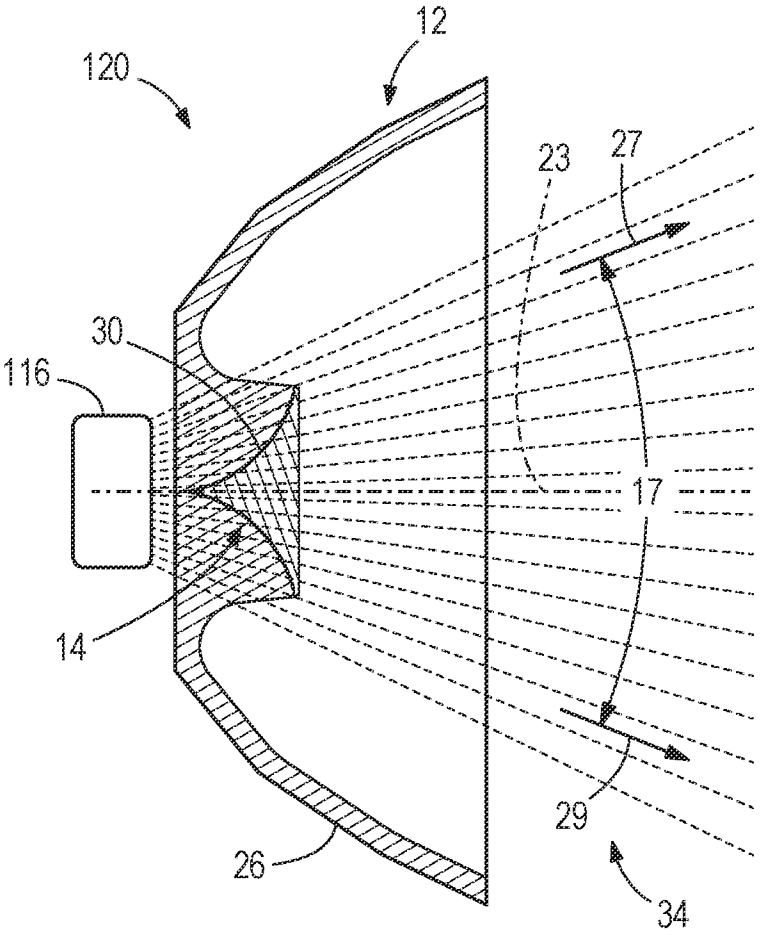
FIG. 3 is a schematic cross-sectional view of the zoom mechanism of FIG. 2, illustrated in a wide zoom configuration.
Figure 4:
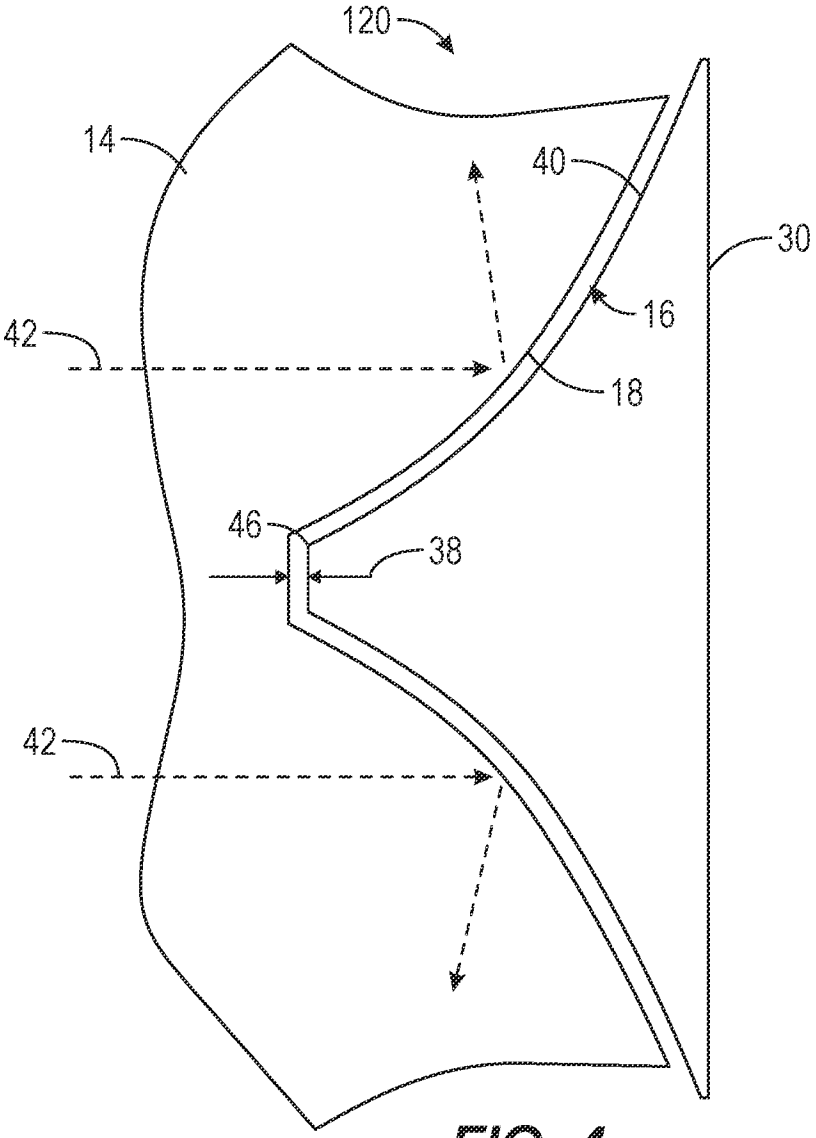
FIG. 4 is an enlarged view of the zoom mechanism of FIG. 2 in the narrow zoom configuration.

Referring to FIGS. 3 and 4, the illustrated optic assembly 120 includes a movable element or plug 30 made of an optically translucent, resilient material, such as an elastomer material. For example, in some embodiments the elastomer material is silicone. In some embodiments, both the lens 12 and the plug 30 may be made of silicone. In other embodiments, the lens 12 and the plug 30 may be made of different materials, including different elastomer materials. The plug 30 is insertable into the recess 16 to disrupt the air/lens boundary at the inner wall 18 of the recess 16, thereby frustrating total internal reflection. As illustrated in FIG. 3, when the total internal reflection caused by the projecting portion 14 is frustrated, light emitted by the LED light source 116 passes through the projecting portion 14 and the optically translucent plug 30 without being reflected. Light emitted by the LED light source 116 is therefore allowed to spread outwardly without being collimated by the surround 26. That is, when the plug 30 is inserted into the recess 16, the light exits the lens 12 as a wider beam 34.

Referring to FIG. 4, in order for the plug 30 to frustrate internal reflection, a distance 38 between an exterior surface 40 of the plug 30 and the inner wall 18 of the recess 16 must be less than a critical distance on the order of the wavelength of the light emitted by the LED light source 116. Because this critical distance is extremely small (between about 400 nanometers and about 700 nanometers), the exterior surface 40 of the plug 30 and the inner wall 18 of the recess 16 can be considered to be in contact when the distance between the exterior surface 40 and the inner wall 18 is less than the critical distance. That is, the term "contact," as used herein, means spaced by a distance less than the critical distance. Because the plug 30 is made of a resilient material, the plug 30 may deform when it engages the inner wall 18 of the recess 16. This advantageously allows the plug 30 to fully contact the inner wall 18 of the recess 16 and conform to the shape of the inner wall 18. As such, the dimensional tolerance requirements for the plug 30 and the recess 16 are reduced.

Figure 5:
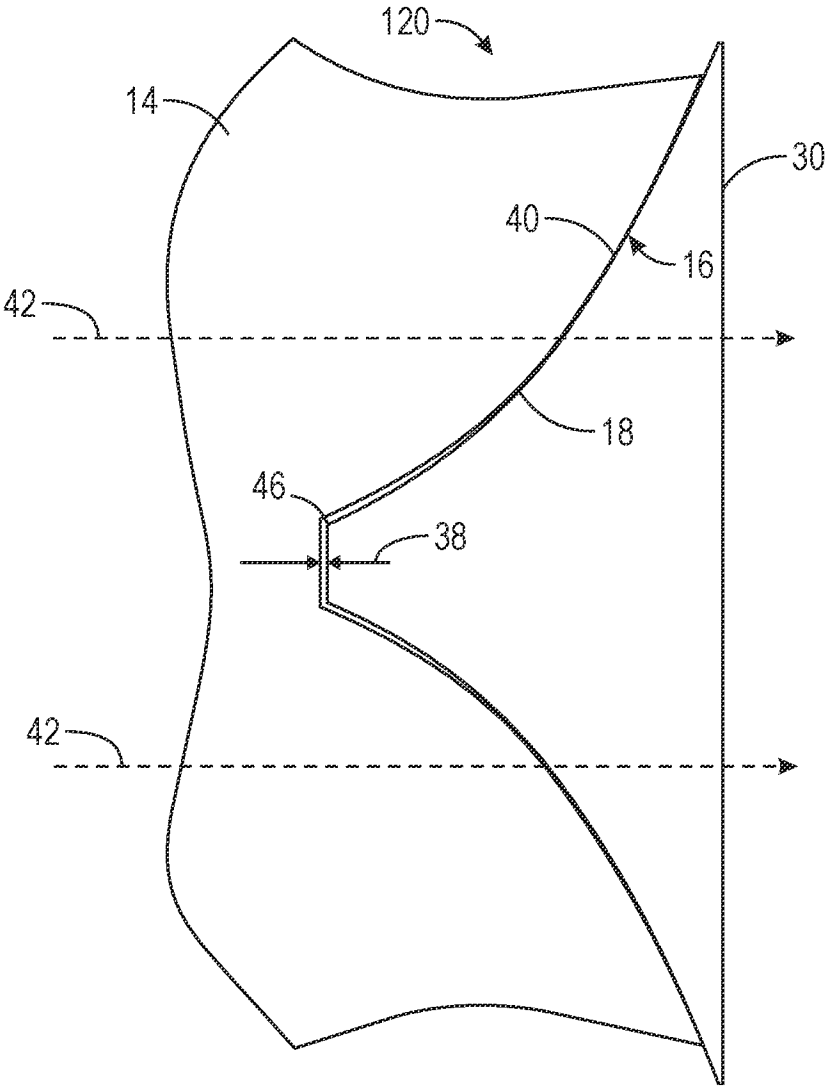
FIG. 5 is an enlarged view of the zoom mechanism of FIG. 2 in the wide zoom configuration.

In operation, the optic assembly 120 adjusts the beam angle 17 of the LED 116 by moving the plug 30 between at least a first position (FIG. 4) and a second position (FIG. 5). In the first position, the distance 38 between the exterior surface 40 of the plug 30 and the inner wall 18 of the recess 16 is greater than the critical distance. As such, light emitted by the LED light source 116 (generally in the direction of arrows 42) will reflect via total internal reflection at the air/lens interface along the inner wall 18 of the recess 16. The reflected light encounters the surround 26, which in turn reflects the light out of the lens 12 in a generally focused, collimated beam 28 (FIG. 2). In some embodiments, the beam 28 has a beam angle 17 between 0 degrees and 30 degrees. In other embodiments, the beam 28 has a beam angle 17 between 2 degrees and 15 degrees. In yet other embodiments, the beam 28 has a beam angle 17 between 5 degrees and 10 degrees. In the illustrated embodiment, the beam 28 has a beam angle 17 of about 7.6 degrees.

When the plug 30 is moved to the second position (FIG. 5), the distance 38 between the exterior surface 40 of the plug 30 and at least a portion of the inner wall 18 of the recess 16 is less than the critical distance. In other words, the exterior surface 40 of the plug 30 contacts at least a portion of the inner wall 18. This frustrates the total internal reflection, such that light emitted by the LED light source 116 may pass through the projecting portion 14 and the optically translucent plug 30 without being reflected. Light emitted by the LED light source 116 is thus allowed to spread outwardly as a wider beam 34 without being collimated by the surround 26 (FIG. 2). In some embodiments, the beam 34 has a beam angle 17 between 30 and 60 degrees. In other embodiments, the beam 34 has a beam angle 17 between 45 and 50 degrees. In a particularly preferred embodiment, the wider beam 34 shown in FIG. 3 has a beam angle 17 of about 47 degrees.

Thus, the optic assembly 120 acts as a zoom mechanism capable of providing a wide zoom configuration and a narrow zoom configuration by moving the plug 30 between the first position and the second position. In addition, the plug 30 need only move a small distance to change the zoom configuration. In particular, the distance between the first position and the second position may be any distance greater than the critical distance. For example, in some embodiments, the plug 30 may move a distance of 0.5 millimeters or less from the first position to the second position. In other embodiments, the plug 30 may move a distance of 1 millimeter or less from the first position to the second position. In other embodiments, the plug 30 may move a distance of 5 millimeters or less from the first position to the second position.

The optic assembly 120 may include any suitable means for moving the plug 30 relative to the lens 12. For example, the plug 30 and the lens 12 may be coupled together by a threaded connection. In such embodiments, rotation of one of the plug 30 or the lens 12 relative to the other causes the plug 30 to move between the first position and the second position. In other embodiments, the plug 30 may by moved by a magnetic actuator, a fluid actuator, a motor or the like. The means for moving the plug 30 is preferably electronically controllable, such that the optic assembly 120 can be controlled by an electronic controller of the light fixture 100.

The wide zoom configuration of the optic assembly 120 may provide a beam angle 17 at least six times wider than the beam angle 17 in the narrow zoom configuration in some embodiments, or at least four times wider than the beam angle 17 in the narrow zoom configuration in other embodiments. In both configurations, the optic assembly 120 advantageously maintains a high optical efficiency. For example, in some embodiments, the optical efficiency in both the wide zoom configuration and in the narrow zoom configuration is greater than 70%.

In some embodiments, the optic assembly 120 may be configured to provide more than two zoom configurations. For example, in some embodiments, the plug 30 and the recess 16 may be shaped to provide a contact area that increases along the inner wall 18 of the recess 16 as a function of pressure applied to the plug 30. In such embodiments, a tip portion 46 of the plug 30 may contact the wall 18 in an intermediate position between the first position (FIG. 4) and the second position (FIG. 5) of the plug 30. In the intermediate position, a portion of the plug 30 radially outward of the tip portion 46 may remain spaced from the inner wall 18. As such, the plug 30 only partially frustrates total internal reflection when in the intermediate position, providing a zoom configuration between the wide zoom configuration and the narrow zoom configuration. In some embodiments, the plug 30 may be movable to a plurality of intermediate positions. In yet other embodiments, the contact area between the plug 30 and the inner wall 18 of the recess 16 may be variable to provide a continuously variable zoom function.

Figure 6:
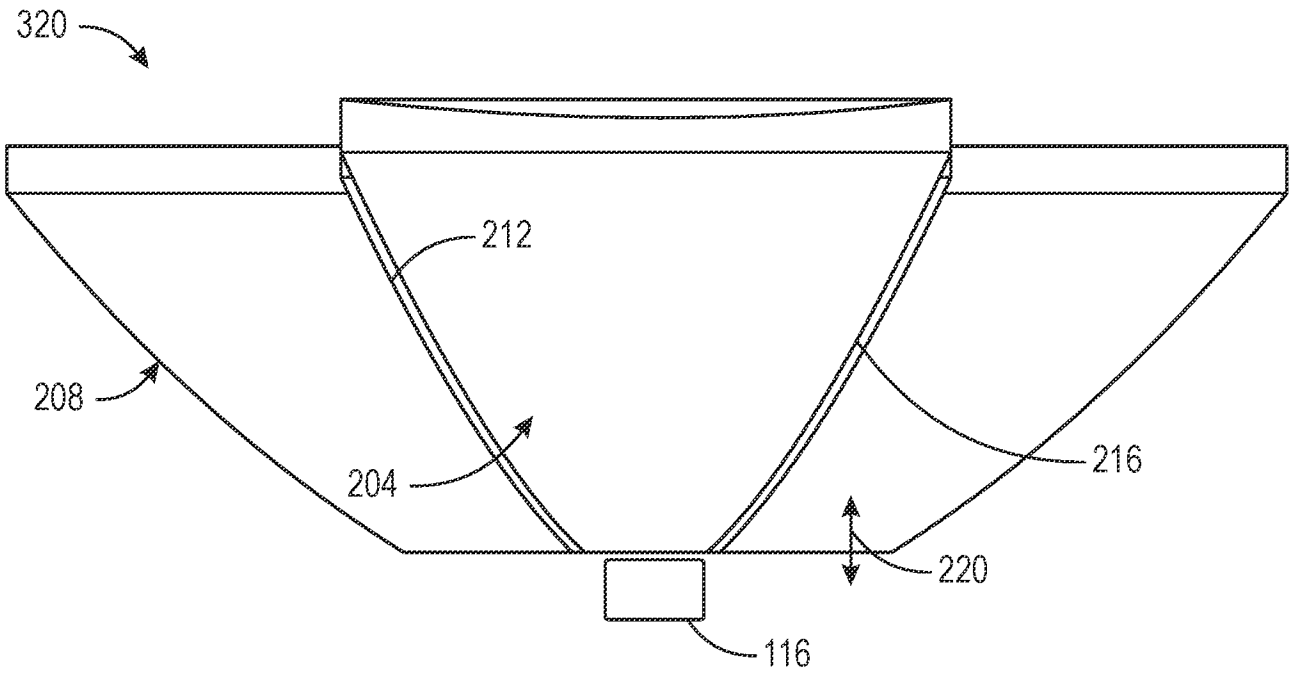
FIG. 6 is a cross-sectional view of a zoom mechanism according to another embodiment.

FIG. 6 illustrates an optic assembly 320 according to another embodiment. The optic assembly 320 is configured as an optic assembly that can be incorporated into the light fixture 100 of FIGS. 1A-B in place of one or more of the optics 120. In other embodiments, the optic assembly 120 can be incorporated into light fixtures of other types and configurations. The optic assembly 320 is similar to the optic assembly 120 described above with reference to FIGS. 2-5, and the following description focuses primarily on differences between the optic assembly 320 and the optic assembly 120.

Referring to FIG. 6, the illustrated optic assembly 320 includes an inner lens 204 fixed to a light source, such as one of the LED light sources 116, and an outer lens 208 surrounding the outer periphery of the inner lens 204. The outer lens 208 has an inner wall 212 shaped to conform to an outer wall 216 of the inner lens 204. The outer lens 208 is movable relative to the inner lens 204 in the direction of arrows 220 to selectively move the inner wall 212 of the outer lens 208 into contact with the outer wall 216 of the inner lens 204. In the illustrated embodiment, at least one of the outer lens 208 or the inner lens 204 is made of an optically translucent, resilient and/or elastomer material, such as silicone, facilitating form-fitting engagement of the inner wall 212 and the outer wall 216.

When the walls 212, 216 are in contact (i.e. when a spacing between the walls 212, 216 is less than the critical distance), total internal reflection within the inner lens 204 is frustrated, and the light rays emitted by the LED 116 pass through the inner lens 204 to be reflected out of the optic assembly 320 by the outer lens 208. The inner lens 204 and the outer lens 208 have different curvatures, such that light reflected by the inner lens 204 exits the optic assembly 320 at a wider beam angle 17, and light reflected by the outer lens 208 exits the optic assembly 320 at a narrower beam angle 17. As such, movement of the outer lens 208 relative to the inner lens 204 provides different zoom levels.

Although the invention has been described in detail with reference to certain preferred embodiments, variations and modifications exist within the scope and spirit of one or more independent aspects of the invention as described.

Various features of the invention are set forth in the following claims.

What is claimed is:

1. A light fixture comprising:

a housing;

a light source supported within the housing, the light source configured to emit light; and a zoom mechanism configured to selectively vary a beam angle of the light emitted from the light fixture, the zoom mechanism including:

a lens fixed relative to the light source; and a movable element movable relative to the lens between a first position and a second position, wherein the lens is configured to reflect a portion of the light emitted by the light source via internal reflection when the movable element is in the first position, and wherein the movable element is closer to at least a portion of the lens when the movable element is in the second position to disrupt a boundary between ambient air and the lens, thereby at least partially frustrating the internal reflection such that the lens reflects less of the portion of the light emitted by the light source when the movable element is in the second position than when the movable element is in the first position.

2. The light fixture of claim 1, wherein the zoom mechanism selectively varies the beam angle between a first beam angle when the movable element is in the first position and a second beam angle when the movable element is in the second position, and wherein the first beam angle is narrower than the second beam angle.

3. The light fixture of claim 2, wherein the first beam angle is between 2 degrees and 15 degrees, and wherein the second beam angle is between 30 degrees and 60 degrees.

4. The light fixture of claim 3, wherein the first angle is between 5 degrees and 10 degrees, and wherein the second beam angle is between 45 degrees and 50 degrees.

5. The light fixture of claim 2, wherein the second beam angle is at least four times greater than the first beam angle.

6. The light fixture of claim 5, wherein the second beam angle is at least six times greater than the first beam angle.

7. A method for controlling a beam of light, the method comprising:

providing the light fixture of claim 1, and moving the movable element from the first position to the second position.

8. The light fixture of claim 1, wherein the movable element is deformable to increase a contact area between the movable element and the lens when the movable element moves from the first position toward the second position.

9. The light fixture of claim 1, wherein the lens includes a projecting portion having a cone-shaped recess, and wherein the movable element is at least partially positioned within the recess when the movable element is in the second position.

10. The light fixture of claim 1, wherein the movable element is engageable with an outer periphery of the lens when the movable element is in the second position.

11. A zoom mechanism configured to selectively vary a beam angle of light emitted from a light source, the zoom mechanism comprising:

a lens; and a movable element movable relative to the lens between a first position and a second position, wherein the lens is configured to reflect a portion of the light emitted by the light source via internal reflection when the movable element is in the first position, and wherein the moveable element in the second position disrupts a boundary between ambient air and the lens, thereby frustrating the internal reflection such that less than the portion of the light emitted by the light source is emitted by the lens via total internal reflection.

12. The zoom mechanism of claim 11, wherein the movable element is made of an optically translucent material.

13. The zoom mechanism of claim 12, wherein the movable element is made of a resilient material.

14. The zoom mechanism of claim 13, wherein the movable element is made of an elastomer material.

15. The zoom mechanism of claim 11, wherein the movable element is positioned within less than about 700 nanometers of at least a portion of the lens when the movable element is in the second position, and wherein the movable element is deformable to increase a contact area between the movable element and the lens when the movable element moves from the first position toward the second position.

16. The zoom mechanism of claim 11, wherein the lens includes a projecting portion having a cone-shaped recess.

17. The zoom mechanism of claim 16, wherein the movable element is at least partially positioned within the recess when the movable element is in the second position.

18. The zoom mechanism of claim 11, wherein the movable element surrounds an outer periphery of the lens.

19. The zoom mechanism of claim 18, wherein the movable element is configured to contact the outer periphery of the lens when the movable element is in the second position.

20. The zoom mechanism of claim 11, wherein the zoom mechanism selectively varies the beam angle between a first beam angle when the movable element is in the first position and a second beam angle when the movable element is in the second position, and wherein the first beam angle is wider than the second beam angle.

* * * * *